United States Patent [19]

Suda

[11] Patent Number: 4,901,370

[45] **Date of Patent: * Feb. 20, 1990**

[54] GARMENT FOR PROTECTING AGAINST ENVIRONMENTAL CONTAMINATION

[75] Inventor: James R. Suda, Fairfax, Va.

[73] Assignee: Redi-Corp Protective Materials, Inc., Chantilly, Va.

[ * ] Notice: The portion of the term of this patent subsequent to May 23, 2006 has been disclaimed.

[21] Appl. No.: 352,319

[22] Filed: May 16, 1989

Related U.S. Application Data

[63] Continuation of Ser. No. 231,418, Aug. 12, 1988, Pat. No. 4,847,914, which is a continuation of Ser. No. 49,355, May 14, 1987, Pat. No. 4,831,664.

[51] Int. Cl.[4] ..... A41D 13/02

[52] U.S. Cl. ..... 2/2; 2/81; 2/84; 128/205.29; 428/288; 428/297

[58] Field of Search ..... 2/2, 2.1 R, 2.1 A, 79, 2/84, 81, 82, 272, 275; 128/205.29, 206.15; 428/221, 245, 288, 297

[56] References Cited

U.S. PATENT DOCUMENTS

| | | |
|---|---|---|
| 2,062,325 | 12/1936 | Manson . |
| 2,306,488 | 12/1942 | Morner . |
| 3,164,840 | 1/1965 | Reynolds . |
| 3,185,149 | 5/1965 | Rentsch Jr. . |
| 3,516,404 | 6/1970 | Spross . |
| 3,525,334 | 8/1970 | Braman et al. . |
| 3,680,555 | 8/1982 | Warncke . |
| 3,789,839 | 2/1974 | Lund et al. . |
| 3,990,112 | 11/1976 | Ciffolillo . |
| 4,207,882 | 6/1980 | Lemere . |
| 4,272,851 | 6/1981 | Goldstein . |
| 4,296,746 | 10/1981 | Mason Jr. et al. . |
| 4,411,023 | 10/1983 | Pinson . |
| 4,458,680 | 7/1984 | Childers et al. . |
| 4,466,432 | 8/1984 | Wise . |
| 4,583,535 | 4/1986 | Saffo . |
| 4,614,186 | 9/1986 | John . |

FOREIGN PATENT DOCUMENTS

| | | |
|---|---|---|
| 1038968 | 6/1962 | United Kingdom . |
| 1579942 | 2/1977 | United Kingdom . |

OTHER PUBLICATIONS

"For Hazardous or Dirty Jobs . . . Protect Your Workers with Garments of TYVEK", pp. 8 and 9.

"Tech Data Bullentin 3m", 2 pages, Filtrete Brand Type G Filter Media.

*Primary Examiner*—H. Hampton Hunter

*Attorney, Agent, or Firm*—Diller, Ramik & Wight

[57] ABSTRACT

A protective garment for protecting the wearer against adverse effects of chemical, biological and like environmental contamination including a body garment defined by a pair of legs, a pair of arms, a body and a hood with the latter including a transparent window and at least two openings, a plurality of ultrasonic welds seaming the components of the garment together, the garment being formed of a laminate including an outer layer defined by an impermeable ply of synthetic polymeric/-copolymeric plastic material and an inner ply formed as an admixture of synthetic polymeric/copolymeric plastic material fibers and an adhesive; the plies being fused to each other by the adhesive, the fibers defining a porosity sufficient to function as a filter for relatively large size contaminants in the event the impermeable ply becomes torn, punctured or the impermeable integrity thereof is otherwise damaged; a filter covering one of the openings for filtering contaminated air drawn therethrough as a wearer of the garment inhales, a conduit for conducting a wearer's exhaled air to atmosphere through the other opening, a valve associated with the conduit for preventing contaminated air from entering the garment through the conduit, the conduit being flexible and including within the hood a mouthpiece adapted for retention in the mouth of a user whereby exhaled air egresses the garment directly through the conduit and prevents pressurization thereof and/or fogging of the window, and the filter covering the opening being effective to preclude the passage therethrough of contaminant particles 0.3 microns and greater in diameter at an efficiency of 100% at 150 gm/m$^2$.

14 Claims, 2 Drawing Sheets

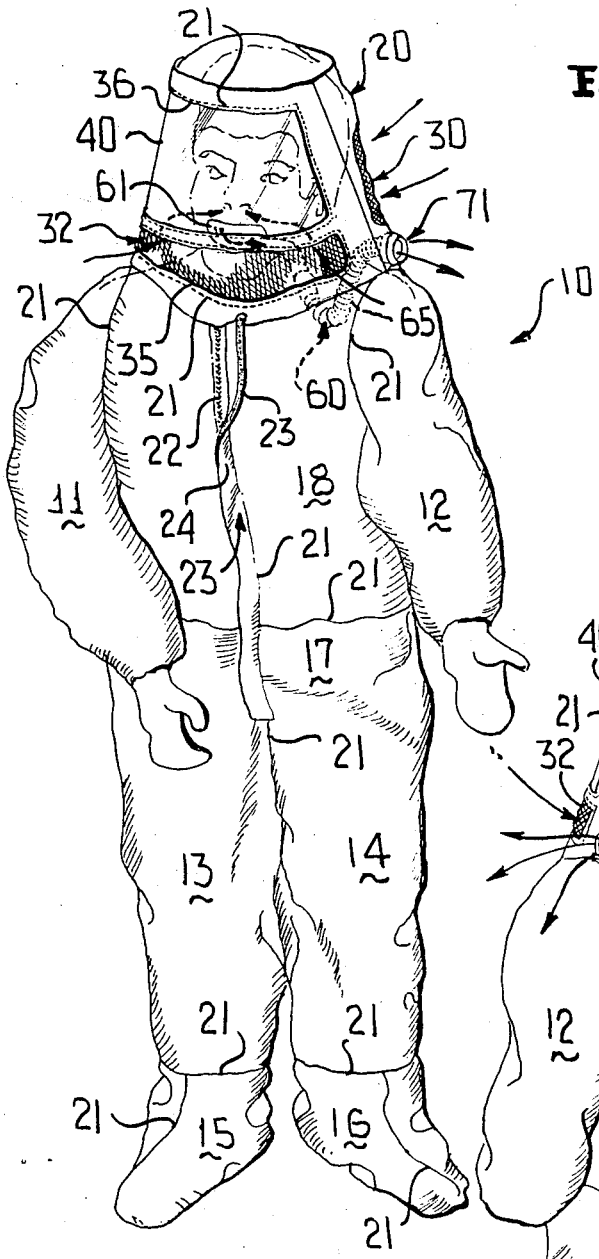
FIG. 1
FIG. 2
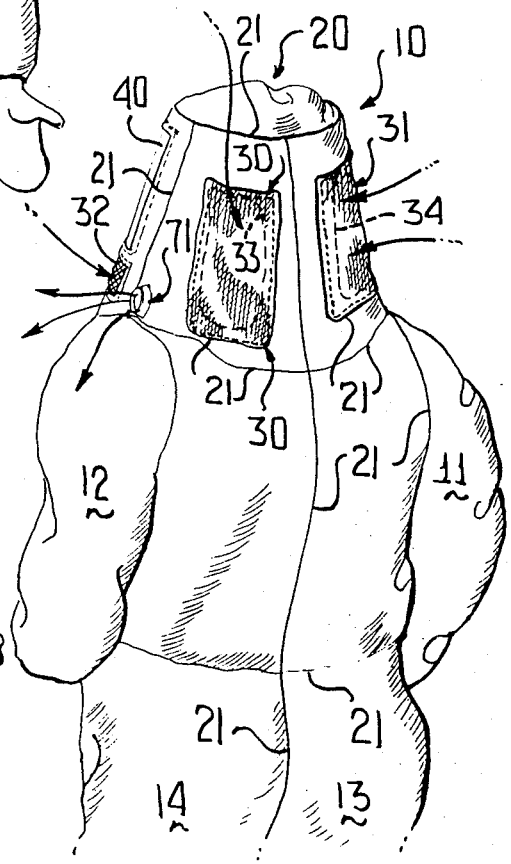

GARMENT FOR PROTECTING AGAINST ENVIRONMENTAL CONTAMINATION

This application is a continuation of application Ser. No. 07/231,418, filed Aug. 12, 1988, now Pat. No. 4,847,914 dated July 18, 1989; which is a continuation of 07/049,355 of May 14, 1987, now Pat. No. 4,831,664 of May 23, 1989.

BACKGROUND OF THE INVENTION

The invention relates to protective apparel and particularly a protective suit which protects the user/-wearer against the adverse effects of chemical, biological, nuclear and like environmental contamination.

Typical of such protective garments designed to protect workers in hazardous or contaminated environmental areas is exemplified by the protective garment disclosed in Pat. No. 4,272,851 in the name of Lynn E. Goldstein issued June 16, 1981. While fundamentally sound in theory, this protective garment includes numerous disadvantages, most notable of which is the utilization of an external pressurized source for introducing pressurized clean filtered breathable air into the garment. This pressurization creates an automatic "tether" which limits mobility of the wearer and the "balloon" effect of the pressurization creates added restrictions to mobility and dexterity, not to mention the fact that internal fresh air and exhaled air creates condensation which undesirably accumulates upon the associated transparent visor of the hood. Thus, while the protective garment is, as noted earlier, fundamentally sound in certain specifics (ultrasonic welding of seams), it is structurally and functionally unsound in areas of utmost concern, namely, maximum protection, filtration, mobility, comfort, durability and internal condensation-resistance.

Other protective garments not only isolate the wearer from hostile environments, but attempt to do so through a "closed circuit" type garment in which filters, valves, respirators, separate air supplies, etc. are utilized, although in some of these auxilliary external air supplies are also mentioned, as in Pat. No. 4,458,680 in the name of Edward L. Childers et al issued July 10, 1984. However, for the most part, such systems are self contained and typical so-called air supply hoods, protective gear, biological isolation garments, smoke protective hoods and/or air survival units are disclosed in representative Pat. Nos. 4,466,432; 3,185,149; 3,516,404; 4,411,023 and 4,614,186.

The utilization of mouthpieces and/or face masks in the general environment of masks, though not necessarily protective garments, is also evidenced by the patents to Warncke No. 3,680,555, Manson No. 2,062,325 and Lemere No. 4,207,882. The latter patent includes a typical scuba diving equipment mouthpiece through which air is inhaled from the exterior through filters associated with a welding mask. Exhalation through a separate branch from the mouthpiece is also provided and obviously presents the undesired high risk of environmental contamination because inhalation and exhalation are part of the same breathing system.

Surgical masks, head masks and the like, formed of relatively light-weight and disposable material are also commonplace, as evidenced by the patents to Lund et al No. 3,789,839; Saffo No. 4,583,535; and Mason Jr. et al No. 4,296,746.

Collectively these patents represent an overall background to which the present invention constitutes an unobvious and novel improvement.

SUMMARY OF THE INVENTION

The invention is directed to protective apparel particularly designed to protect the wearer/user against the adverse effects of chemical, biological, nuclear and like environmental contamination and includes a body garment defined by a pair of legs, arms, a body and a hood secured together by ultrasonically welded seams. The body garment is formed from a laminate which includes a first layer of material adapted to provide contaminant protection by means of an outer impermeable ply of synthetic polymeric/copolymeric plastic material. An inner ply of the laminate is formed as an admixture of such polymeric/copolymeric material in fiber form and an adhesive; the inner ply defining a generally porous, soft, smooth, moisture absorbent internal surface and the adhesive homogeneously interspersed therethrough effectively laminating the impermeable and porous plies to each. The fibers are of a porosity sufficient to function as a filter for relatively large sized contaminants in the event the impermeable ply becomes torn, punctured or the impermeable integrity thereof is otherwise damaged. A transparent window in the hood, at least one opening in the hood, and filter means covering the opening filters contaminated air drawn therethrough as a wearer of the garment inhales. A conduit is provided for conducting exhaled air to atmosphere directly from the mouth of a wearer, and valve means is associated with the conduit for preventing contaminated air from entering the garment by undesired reverse flow through the conduit.

The invention is further characterized by providing the valve means in the form of a check valve which opens when the wearer exhales and closes when the wearer inhales, and further filter means are operative should the check valve become inoperative, the further filter means preventing contamination from entering the mouthpiece upon inadvertent inhalation of contaminated air should the check valve be damaged or inadvertently maintained in an open position.

The invention is further characterized by forming the conduit of flexible material, and the mouthpiece of hypoallergenic material is connected to the conduit for retention in the mouth of a wearer whereby exhaled air egresses the apparel directly thus preventing pressurization of the apparel and/or fogging of the window.

The invention is also characterized by forming the filter means as synthetic air filter media formed of permanent electrets in the form of a fibrous mat, the filter covers the at least one opening, the opening is formed in the hood below the transparent window, and alternately or additionally, at least two other openings covered by the filter media fibrous mats are covered to augment total filtered air ingress into the garment.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a front perspective view of a body garment designed to protect the wearer against the adverse effects of chemical, biological, nuclear and like environmental contamination, and illustrates a hood having a transparent window, a filter therebelow through which air is inhaled by the wearer, and a mouthpiece connected to a flexible conduit for exhaling air through a check valve and an associated filter.

FIG. 2 is a fragmentary perspective view of the protective garment of FIG. 1, and illustrates two elongated openings formed in a back wall of the hood, each covered by a filter.

DESCRIPTION OF THE PREFERRED EMBODIMENTS

Figure 5:
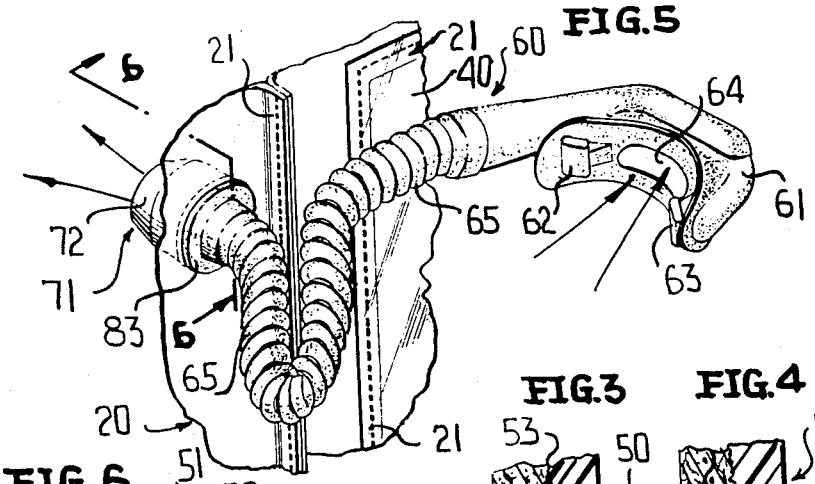
FIG. 5 is a fragmentary perspective view of an interior portion of the hood, and illustrates details of the exhalation conduit, an associated mouthpiece, and a housing for a valve and filter.

Protective apparel constructed in accordance with this invention is fully illustrated in FIGS. 1 and 2 of the drawings, and includes a protective body garment or suit 10 which is designed to protect the wearer/user against the adverse effects of chemical, biological, nuclear and like environmental contamination.

The protective body garment 10 includes a pair of arms 11, 12; a pair of legs 13, 14; feet 15, 16 associated with the respective legs 13, 14; a hip section or portion 17, a body section 18, and a hood or headpiece 20.

The arms 11, 12, legs 13, 14, feet 15, 16, etc., are selectively ultrasonically welded along seams 21. The ultrasonically welded seams 21 maintain the garment hermetically sealed along the seams which would not, of course, occur if the seams 21 were simply machine-needle-stitched.

A front access opening (not shown) of the garment 10 is closed by an elongated generally vertically disposed zipper 22 which can be open and closed in a conventional manner, and sewn along one edge by an ultrasonically welded seam 21 is a flap 23 having a longitudinally edge 24 covered on its inside surface (unnumbered) by a pressure-sensitive adhesive 25 which is also covered by a removable strip of paper (not shown). When the zipper 22 is opened, the wearer enters the protective garment 10, zips the zipper 22 closed, removes the paper from the adhesive 25, and overlies the zipper 25 by the flap 23 with the adhesive 25 adhering to the opposing surface (unnumbered) of the body section 18 to hermetically seal the zipper 22 and prevent contaminants from entering therethrough into the interior (unnumbered) of the protective garment 10.

Except for filter means 30, 31 and 32, which will be described more fully hereinafter, which cover respective openings or apertures 33, 34, 35 and a transparent window or visor 40 (FIG. 1), the protective body garment 10 is formed of a laminate 50 (FIG. 3) formed of two layers of material, namely, a first outermost layer 51, and a second innermost layer 52. The outermost layers 51 of the laminate 50 provides light-weight strength and impenetrability to contaminants, and constitutes an outer impermeable ply of synthetic polymeric or copolymeric plastic material, such as a sheet of 0.5 mil polyethylene, ethylvinyl alcohol which is virtually impenetrable by the smallest of particles, be they radioactive, bacteriological, carcinogenic or simply dust. The innermost layer 52 of the laminate 50 is also formed of a synthetic polymeric or copolymeric plastic material which is equally totally impermeable, if in sheet form, but instead is provided in the form of a porous fibrous mat or pad in homogeneous admixture within an adhesive, and under heat and pressure is bonded or fused along an interface 53 to the outer layer 51. Thus the innermost layer 52 is itself a filter which will prevent contaminated particles from entering the garment 10 should, for example, the outermost layer 51 be torn, punctured or its impermeable integrity otherwise damaged. The porosity of the innermost layer 52 is such as to exclude relatively large size particles from entering through tears, punctures, fissures or the like in the outermost layer 51 and may, for example, be of a size to prevent the entry of particles approximately 0.5 micron in diameter. The synthetic polymeric/copolymeric plastic material of the innermost layer 52 is preferably nonwoven hot blown polyester and the homogeneously admixed adhesive is polybenzol acrilate. The laminate 50 is preferably formed by first extruding the outermost layer 51 or removing the outermost layer 51 from a web, dispersing a desired depth and consistency of the admixed polyester fibers and adhesive upon the surface thereof as a nonfused/nonbonded layer 52, and subjecting the latter to heat and pressure to cause the bonding at the interface 53. The innermost layer 52 thus imparts to the garment 10 light-weight bulk, comfort, moisture absorbency, smoothness and hypoallergenic characteristics. Furthermore, since the innermost layer 52 is formed of bonded fibers, it has high tear and tensile strength and resists tearing, puncturing, abrasions or the like which might otherwise might occur in the outer layer 51. However, in the event it is desired to provide still further strength and toughness, the laminate 50 can be further reinforced to form a laminate 50′ (FIG. 4). The laminate 50′ is identical to the laminate 50, and thus the two layers 51′,52′ and the interface 53′ therebetween are identified by identical though primed reference numerals. The difference between the two laminates 50, 50′ is that in the laminate 50′ the innermost layer 52′ is further reinforced by a reinforcing mesh or scrim of polypropylene or polyester or similar synthetic polymeric or copolymeric material, and the mesh, web or scrim is generally identified by the reference character 54. Obviously, in the production of the laminate 50′ the outermost layer 51′ is first covered with a partial layer of the admixed innermost layer 52, the scrim or mesh 54 is then placed thereupon, and further of the admixed innermost layer material is deposited over the scrim after which the layers 51′, 52′ are subject to heat and pressure to create the bonded interface 53′.

Figure 3:
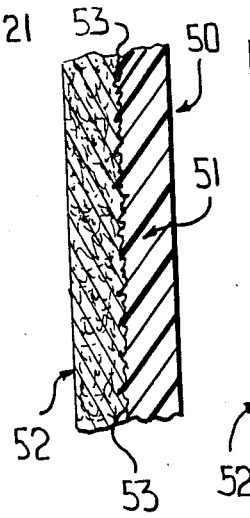
FIG. 3 is an enlarged fragmentary cross-sectional view taken through the protective body garment of FIGS. 1 and 2, and illustrates an outer impermeable ply of synthetic polymeric/copolymeric material and fibers of the same material admixed with an adhesive to define a porous interior ply. p
Figure 4:
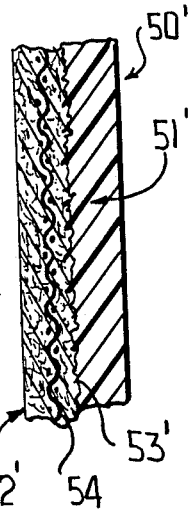
FIG. 4 is an enlarged fragmentary cross-sectional view similar to FIG. 3 and illustrates the innermost admixed fibrous/adhesive ply reinforced by a polymeric/copolymeric mesh.

From the foregoing description of FIGS. 3 and 4 it will be readily apparent that the protective garment 10 is throughout its entirety virtually impenetrable to contamination due to the impermeable nature of the outermost layer 51, yet should the latter tear, relatively large sized particles of contamination (0.5 micron and larger) will be precluded from passing through the innermost layer 52. Thus, the innermost layer 52 offers substantially total contamination protection throughout the entire interior of the protective garment 10.

Figure 7:
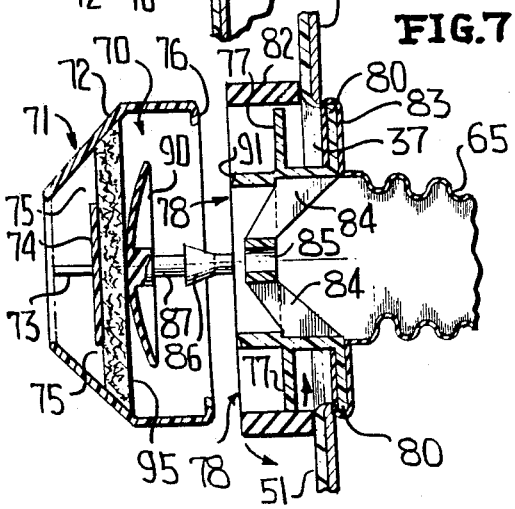
FIG. 7 is a fragmentary cross-sectional view similar to FIG. 6, and illustrates the components prior to assembly thereof.
Figure 8:
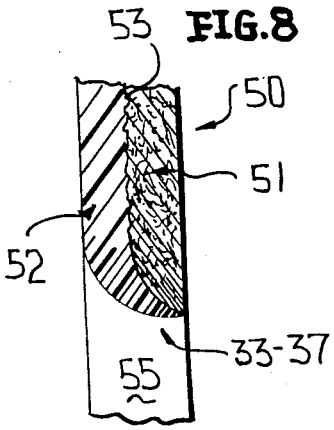
FIG. 8 is an enlarged cross-sectional view of the laminate of FIG. 3, and illustrates a heat sealed circular opening to which the valve housing is connected.

The filter means or filters 30–32 are similarly ultrasonically welded along seams 21 over the respective openings 33–35, and the latter openings all have heat sealed or melted peripheral edges, as indicated by the melted, heat sealed and fused edge 55 of FIG. 8. The edge portion 55 represents the heat sealed and bonded characteristic of each of the openings 33–35, as well as an opening 36 closed by the transparent window or visor 40 and, most importantly, a circular opening or aperture 37 (FIGS. 6 and 7), the latter which will be described more fully hereinafter. However, the heat sealed edge portions 55 of the various openings are formed by cutting the openings with a sharp heated tool which both forms the openings and fuses the edges of both layers 51, 52, as is readily apparent in FIG. 8. This assures that the layers 51, 52 will not lose their integrity, delaminate, etc., and instead the edges 55 are relatively smooth, tough and strong.

The filter means or filters 30–32 function to permit air to be inhaled therethrough by the wearer of the garment 10 as he breathes through his nose, as indicated by the associated unnumbered headed arrows in FIGS. 1 and 2. Obviously, while the air is permitted to flow through the filters 30–32, small particles of contamination must most assuredly be prevented from entering into the interior of the garment 10, and to this end each of the filters 30–32 is preferably a synthetic air filter made of permanent electrets in the form of a fibrous mat. An electret is a nonconductive material with embedded electrical charges which enhance the filtration efficiency over that normally expected from fibers of the particular size of the filter. A preferred form of such media is the Filtrete Brand Type G Filter Media of 3M Company identified specifically as Type G-0115 having a nominal basis weight of 150 $gm/m^2$ which at an air flow rate of 10 feet/min has an efficiency of 90% with respect to particle sizes of 0.3 microns or greater. However, the efficiency is 100% when lower flow rates associated with human's inhalation and exhalation are involved. While Type G-0115 filter media is preferable, Types G-0108, G-0110 and G-0120 are also capable of being utilized as the filtrate material for the filter means 30–32 in keeping with this invention depending, of course, upon the particular contaminated environment which is encountered, be it chemical, biological, radioactive, or otherwise.

The protective body garment 10 also includes a mechanism 60 (FIGS. 5–7) for exhaling air through the garment 10 by means of a mouthpiece 61 formed of hypoallergenic plastic material which is typical of a scuba mouthpiece and includes a pair of ledges 62, 63 which can be gripped between the wearer's teeth and an opening 64 into which air is exhaled and travels through a flexible conduit 65 and associated valve means 70 of a valve housing 71. The valve housing 71 is of a two-piece construction and includes a valve cap 72 (FIG. 7) having a central spider 73 supporting a circular plate 74 which defines with the valve cap 72 a plurality of peripherally spaced openings of slots 75. A radially inwardly directed rib 76 is snapped over a radially outwardly directed annular shoulder or flange 77 of a second part or valve body 78 of the valve housing 71. The valve body 78 includes another radially outwardly directed flange or shoulder 80, and the latter defines with the flange or shoulder 77 an outwardly opening groove or channel 81. A rubber O-ring or grommet 82 functions to clamp the valve body 78 to the garment body 10 and specifically to the hood 20 at the opening 37 and also to secure an end portion 83 of the flexible conduit 65 to the flange 80. The end portion 83 is stretched and folded over the rib 80, as is illustrated in FIG. 7, and the valve body 78 is then inserted into the opening 37 until the opening 37 is in alignment with the groove or channel 81. The rubber O-ring 82 is shown stretched over the rib 77 and against the outermost layer 51 of the laminate 50 in FIG. 7. As the O-ring 82 is forced into the groove 81 it grips and frictionally engages against the outermost layer 51 of the laminate 50 and draws the latter radially inwardly into the groove 81 until such time as the inherent spring-back or resilience of the O-ring 82 snaps the same into its final position (FIG. 6) intimately gripping and retaining the end portion 83 of the conduit 65 and the edge of the opening 37 firmly between the O-ring 82 and the flange 80. If desired, a spot of glue and/or a solvent can be applied to the opposing faces of the O-ring 82 and the outermost layer of the laminate 50 when positioned as shown in FIG. 7 which will bond the O-ring 82 to the outermost layer 51 in the vicinity of the opening 37. When thus bonded, the material at the opening 37 will be drawn generally in an axial direction in FIG. 6 once the ring 82 is firmly seated in the groove 81. Thus, this bonding effects a more rigid and reliable connection between the valve body 78, the hood 70 and the conduit 65 than through the frictional purchase earlier described, although the latter is quite adequate.

Figure 6:
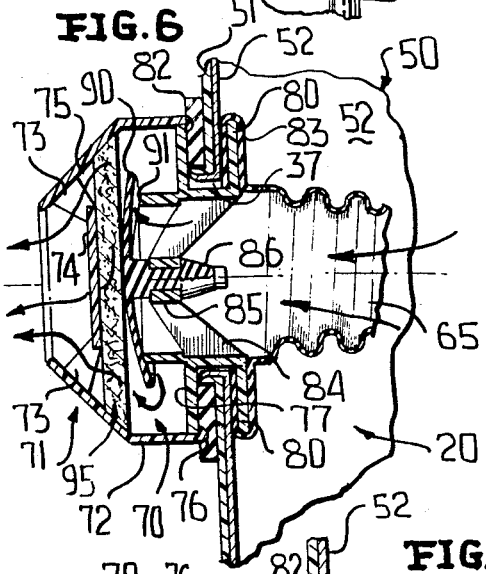
FIG. 6 is an enlarged fragmentary sectional view taken generally along lines 6—6 of FIG. 5, and illustrates the valve housing, the valve thereof in its open position, a filter associated therewith, and the connection between the valve housing, the hood and the flexible conduit.

A spider 84 is formed within the valve body 78 and includes a sleeve 85 which snap-receives therethrough a generally frustoconical portion 86 at the end of a stem 87 carrying a resilient rubber generally circular shallow dome-shaped check valve 90 which normally seats upon a valve seat 91 of the valve body 78 (FIG. 6). Filter means 95 are disposed between the plate 74 and the valve 90, and the filter means or filter corresponds in structure and function to the filter material heretofore described relative to the filters 30–32. The check valve 90 is, of course, designed to open (FIG. 6) when air from the wearer's mouth is exhaled through the mouthpiece 61 via the opening 64 and the flexible conduit 65, and as this occurs the air also flows outwardly through the filter 95. When the wearer ceases exhaling the natural resilience of the valve 90 causes it to seat on the valve seat 91 thereby closing communication and preventing the wearer from inhaling through the valve housing 71, the conduit 65, the mouthpiece 61 and the opening 64 of the latter. To this extent the filter 95 is functionless, but in the absence of the filter means 95 it is possible for a very small piece of dust, debris and/or contamination to lodge between the valve 90 and the valve seat 91 preventing the formation of a hermetical seal therebetween. This would, of course, be most hazardous since the user would most likely breathe air in through his mouth as well as through his nostrils. However, because the filter 95 will block contaminants in a particle size of 0.3 micron and above, it is virtually impossible for the valve 90 to be rendered inoperative, and thus the system 60 assures that only exhaled air of the wearer will exit the garment 10 through the conduit 65 and all inhaled air will enter the garment 10 through the filters 30–32. Moreover, even if the valve 90 is open, few if any contaminants are of a size less than 0.3 microns, and thus cannot be inhaled past the filter 95.

It should be particularly noted that due to this system there is not only provided an assurance against contamination to the wearer, but due to the specific arrangement and function of the inhalation filters 30–32 and the exhalation system 60, pressurization of the interior of the garment 10 which is hermetically sealed, cannot occur and condensation will not collect on the interior of the transparent window 40 (mylar) because normally moist exhaled breath exits the wearer's mouth directly to atmosphere through the exhalation mechanism 60. In this manner the garment 10 assures the wearer complete protection not only against normal adverse effects of chemical, biological, radioactive, nuclear and like environmental contamination, but also assures the same should the outermost layer 51 become torn or its impermeable integrity be otherwise damaged. At the same time malfunction of the valve means 70 will preclude internal contamination by blocking contaminant particles of 0.3 microns in diameter (or larger) upon wearer inhalation through the mouthpiece 61 because of the filter means 95. Obviously, the direct utilization of the exhalation mechanism 60 prevents internal garment pressurization which leads to efficient mobility/dexterity, while the exclusion of condensation assures excellent vision and sight through the window 40.

Although a preferred embodiment of the invention has been specifically illustrated and described herein, it is to be understood that minor variations may be made in the apparatus and the method without departing from the spirit and scope of the invention, as defined in the appended claims.

I claim:

1. Protective apparel designed to protect the user against the adverse effects of chemical, biological and like environmental contamination comprising a body garment defined by a pair of legs, a pair of arms, a body and a hood adapted to totally enclose a wearer thereof; said body garment being defined by a laminate including a first layer of material defining an outer generally impermeable ply of synthetic polymeric/copolymeric plastic material, said laminate including an inner ply of synthetic polymeric/copolymeric plastic material fibers defining a generally porous internal surface; said plies being laminated to each other, said fibers defining a porosity sufficient to function as a filter for relatively large size contaminants in the event said generally impermeable ply becomes torn, punctured or the impermeable integrity thereof is otherwise damaged, a transparent window in said hood, at least one opening in said body garment, filter means covering said opening for filtering contaminated air drawn therethrough as a wearer of the garment inhales, and a conduit for conducting exhaled air to atmosphere.

2. The protective apparel as defined in claim 1 including an aperture in said hood defined by a continuous edge portion of said laminate, said continuous edge portion being received in an outwardly opening peripheral groove of a connecting portion of said conduit, and means for securing said continuous edge portion in said peripheral groove.

3. The protective apparel as defined in claim 1 wherein said fibers are reinforced by a reinforcing mesh of synthetic polymeric/copolymeric plastic material.

4. The protective apparel as defined in claim 1 wherein said conduit is flexible and includes within said hood a hypoallergenic mouthpiece adapted for retention in the mouth of a wearer whereby exhaled air egresses the apparel directly thus preventing pressurization and/or window fogging.

5. The protective apparel as defined in claim 1 wherein said conduit includes valve means operative for preventing contamination from entering said mouthpiece upon inadvertent inhalation of contaminated air through said conduit.

6. The protective apparel as defined in claim 1 wherein said filter means filters contaminants of 0.3u and greater at an efficiency of between 90% to 100% at 150 $gm/m^2$.

7. The protective apparel as defined in claim 1 wherein said conduit includes filter means operative for preventing contamination from entering said mouthpiece upon inadvertent inhalation of contaminated air through said conduit.

8. The protective apparel as defined in claim 1 wherein releasable strap means are provided within said hood to selectively secure said conduit at a desired position relative to the mouth of a wearer.

9. The protective apparel as defined in claim 7 wherein said conduit filter means is a synthetic air filter media formed of permanent electrets in the form of a fibrous mat.

10. The protective apparel as defined in claim 7 wherein said conduit includes valve means operative for preventing contamination from entering said mouthpiece upon inadvertent inhalation of contaminated air through said conduit.

11. The protective apparel as defined in claim 10 wherein said conduit filter means covering is a synthetic air filter media formed of permanent electrets in the form of a fibrous mat.

12. Protective apparel designed to protect the user against the adverse effects of chemical, biological and like environmental contamination comprising a body garment defined by a pair of legs, a pair of arms, a body and a hood adapted to totally enclose a wearer thereof; a transparent window in said hood, at least one opening in said body garment, filter means covering said opening for filtering contaminated air drawn therethrough as a wearer of the garment inhales, a conduit for conducting exhaled air to atmosphere, and said conduit includes valve means operative for preventing contamination from entering said conduit upon inadvertent inhalation of contaminated air through said conduit.

13. The protective apparel as defined in claim 12 including conduit filter means associated with said conduit which is operative should said valve means become inoperative for preventing contamination from entering said conduit upon inadvertent inhalation of contaminated air past said valve means.

14. The protective apparel as defined in claim 13 wherein said conduit filter means is a synthetic air filter media formed of permanent electrets.

* * * * *